US006131422A

United States Patent [19]

Skrippek et al.

[11] Patent Number: 6,131,422

[45] Date of Patent: Oct. 17, 2000

[54] DRIVE DEVICE FOR A WASHING MACHINE

[75] Inventors: Jörg Skrippek, Priort; Reinhard Heyder; Klaus Bierbach, both of Berlin, all of Germany

[73] Assignee: BSH Bosch und Siemens Hausgeraete GmbH, Munich, Germany

[21] Appl. No.: 09/103,165

[22] Filed: Jun. 22, 1998

[30] Foreign Application Priority Data

Jun. 20, 1997 [DE] Germany ..... 197 26 246

[51] Int. Cl.[7] ..... D06F 37/30

[52] U.S. Cl. ..... 68/140; 29/596; 310/42

[58] Field of Search ..... 68/12.16, 24, 140; 310/42, 596, 598; 29/596, 597, 598

[56] References Cited

U.S. PATENT DOCUMENTS

| | | | |
|---|---|---|---|
| 3,484,934 | 12/1969 | Wightman | 310/42 X |
| 4,446,706 | 5/1984 | Hartwig | 68/24 |
| 5,471,732 | 12/1995 | Yumiki et al. | 310/42 X |
| 5,809,809 | 9/1998 | Neumann | 68/140 |
| 5,862,686 | 1/1999 | Skrippek | 68/140 |

FOREIGN PATENT DOCUMENTS

| | | | |
|---|---|---|---|
| 1354594 | 1/1964 | France | 68/24 |
| 4157 | 7/1956 | Germany | 68/24 |
| 6411595 | 4/1965 | Netherlands | 68/140 |

*Primary Examiner*—Philip R. Coe
*Attorney, Agent, or Firm*—Herbert L. Lerner; Laurence A. Greenberg

[57] ABSTRACT

A washing machine includes a laundry drum mounted through an at least approximately horizontally disposed shaft within a bearing sleeve of a rigid star carrier attached to a bottom wall of a tub. A drive device for the washing machine can be mounted on the rear side of the tub. The drive device includes a flat or pancake motor having a stator carrying part with exciting windings and a rotor with magnetizable poles, for driving the laundry drum directly. The stator carrying part and the rotor of the motor are releasably connected to one another, with the stator carrying part in a position relative to the rotor corresponding to an operating position, for a duration of transport of the motor until a final mounting on the bottom wall of the tub. Therefore, the motor can be delivered, ready-preassembled and tested, to the factory manufacturing washing machines. The motor can be installed there in washing machines in a simplified way, without the need for further action on the washing machine when the motor is being installed, which could put at risk adherence to tolerances necessary for the motor to operate properly.

11 Claims, 3 Drawing Sheets

DRIVE DEVICE FOR A WASHING MACHINE

BACKGROUND OF THE INVENTION

Field of the Invention

The invention relates to a drive device for a washing machine having a laundry drum mounted through an at least approximately horizontally disposed shaft within a bearing sleeve of a rigid star carrier attached to a bottom wall of a tub, the drive device being capable of being mounted on a rear side of the tub and including a flat or pancake motor having a stator carrying part with exciting windings and a rotor with magnetizable poles, for directly driving the laundry drum with the drive device.

Such a drive device is known from German Published, Non-Prosecuted Patent Application DE 39 27 426 A1. In that device, the stator carrying part has an insulating part, on which the exciting windings are mounted. The insulating part is annular and is pushed onto the bearing sleeve of the star carrier. A bell-shaped rotor engages around that assembly unit and is fastened, through the use of a screw cap, to a shaft journal of the laundry drum, with the shaft journal projecting rearward beyond the bearing sleeve. Therefore, the stator carrying part, together with the exciting windings, first has to be pushed, preassembled, onto the bearing sleeve in order to assemble the motor. The rotor bell subsequently has to be placed onto the shaft journal and screwed in place. In that case, however, it is certainly impossible to ensure that the internal tolerances (mainly the positioning of the exciting windings in relation to the magnetizable rotor poles) are adhered to, to the extent necessary for the motor to operate properly. This is because time and equipment for adhering to those tolerances are not available in the assembly factory for washing machines.

SUMMARY OF THE INVENTION

It is accordingly an object of the invention to provide a drive device for a washing machine, which overcomes the hereinafore-mentioned disadvantages of the heretofore-known devices of this general type, in such a way that the motor can be delivered, ready-preassembled and tested, to the factory manufacturing washing machines, without the need for further action on the washing machine when the motor is being installed, which could put at risk adherence to tolerances necessary for the motor to operate properly. Moreover, this is to be accompanied by a simplified assembly in the washing machine factory.

With the foregoing and other objects in view there is provided, in accordance with the invention, in a washing machine including a tub having a rear side with a bottom wall, a rigid star carrier attached to the bottom wall of the tub and having a bearing sleeve, an at least approximately horizontally disposed shaft mounted in the bearing sleeve, and a laundry drum mounted on the shaft, a drive device to be mounted at the rear side of the tub for directly driving the shaft, comprising a flat motor having a stator carrying part with exciting windings and a rotor with magnetizable poles, the stator carrying part and the rotor releasably connected to one another with the stator carrying part in a position relative to the rotor corresponding to an operating position, for a duration of transport of the motor until a final mounting on the bottom wall of the tub.

This makes it possible to ensure that the motor can be ready-assembled and tested in the manufacturing factory that is best equipped for this purpose, before it is delivered to a user, for example the factory of a washing machine manufacturer.

In accordance with another feature of the invention, the stator carrying part and the rotor have identical hole patterns, and at least one bore of the hole pattern in the stator carrying part is equipped with a thread for a locking screw screwed in from the rotor. This makes it possible to implement the measure according to the invention. For safety's sake, at least two such locking screws are provided.

In accordance with a further feature of the invention, instead of at least one of a plurality of locking screws, at least one of the bores of the hole pattern in the stator carrying part is constructed with the same diameter as that of the rotor and with a smooth wall and is provided with a locking pin for securing in position during transport.

In accordance with an added feature of the invention, in order to make it easier to mount a motor preassembled according to the invention, the rotor has the form of a bell, the central part of which is constructed as a flat disk and has access bores on a circle with the same radius as the stator carrying part has fastening bores and as the star carrier has threaded holes for mounting the motor on the star carrier.

In accordance with an additional feature of the invention, in order to avoid the need for a special stator carrying part, the stator carrying part is formed by a ring of laminations for the exciting windings.

In accordance with yet another feature of the invention, the ring of laminations are provided on the side facing the star carrier with a ring having a dish-like shape, the outer edge of which reaches to the bell edge through a labyrinth seal.

This is done for better protection of the exciting windings and the magnetizable poles.

Moreover, the advantage of the two embodiments mentioned above is that the rotor bell does not require any holes for the locking screws and locking pins other than the holes for fastening the motor to the star carrier. In order to mount the motor on the washing machine, the locked motor is first connected through its rotor bell to the shaft journal of the laundry drum. A locking pin or one of the locking screws is then pulled out, the position of rotation of the motor in which the holes overlap with those of the star carrier is located and an assembly screw is screwed into the one hole which has become free. The same procedure is thereafter adopted, in sequence, for all of the holes.

In accordance with yet a further feature of the invention, the drive device is best protected if the stator carrying part extends beyond the exciting windings, and its edge, together with that of the bell, forms a labyrinth seal.

In accordance with yet an added feature of the invention, the stator carrying part and/or the bell is/are provided, on the side facing the interspace, with a peripheral collar which forms a labyrinth seal with the respective counterpart on the bell and on the stator carrying part. In this way, the exciting windings and poles are also better protected in the direction of the center of rotation.

In accordance with an additional feature of the invention, the stator carrying part has a central guide sleeve which can be placed through a defined sliding fit onto an outer cylinder of the bearing sleeve of the star carrier. This structure makes it easier to mount the motor on the washing machine, in that the still locked motor, together with its guide sleeve, can be placed onto the bearing sleeve securely in position, so that the central bore for fastening the rotor bell to the shaft journal is centered automatically.

In accordance with yet another feature of the invention, the outside of the guide sleeve has a cylindrical fit with a collar which is attached on the side of the rotor facing the interspace and which is seated on the outer cylindrical fit, in the transport position. Then, in particular, the rotor collar, together with the outer cylinder of the guide sleeve, can already hold the stator carrying part and the rotor in the transport position.

In accordance with a concomitant feature of the invention, this measure is further improved if the locking screws penetrate into threaded bores in the end surface of the guide sleeve, in the transport position.

Other features which are considered as characteristic for the invention are set forth in the appended claims.

Although the invention is illustrated and described herein as embodied in a drive device for a washing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
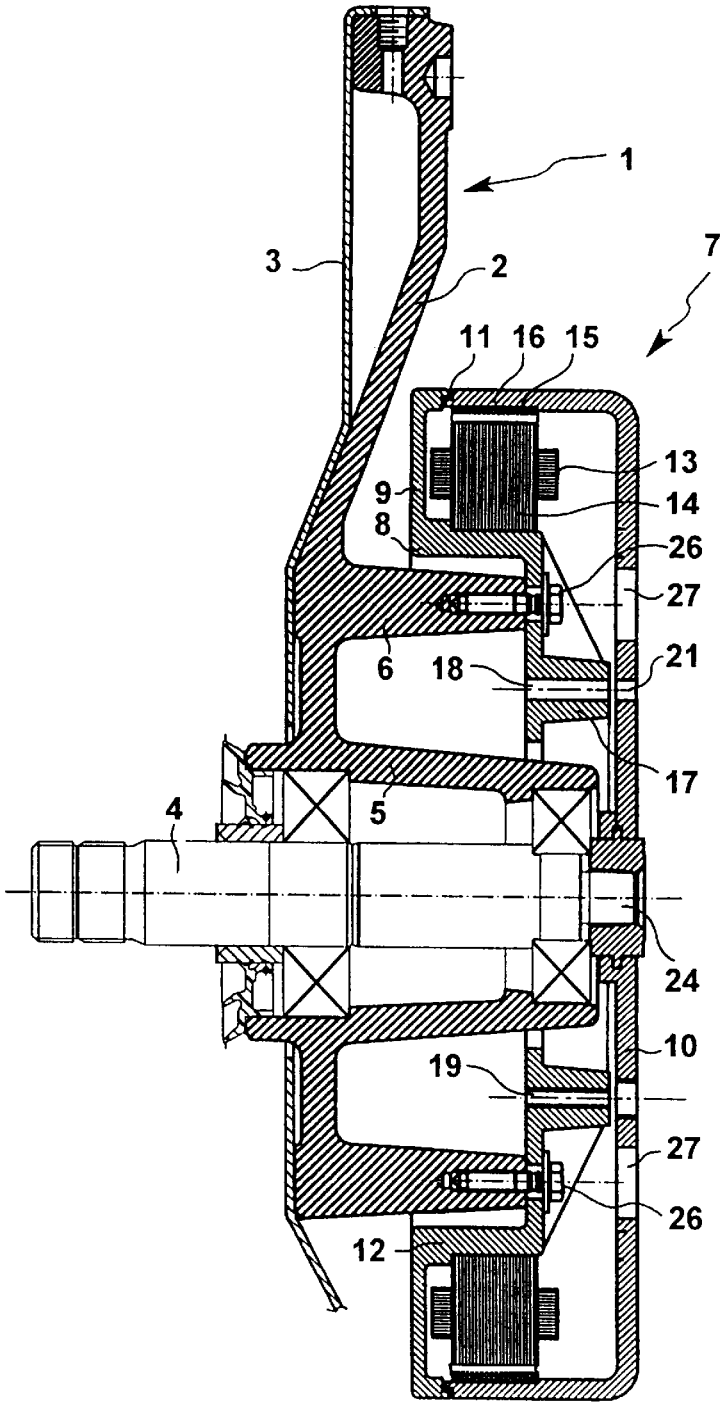
FIG. 1 is a diagrammatic, sectional view of a version of a drive device, in which a stator carrying part and a rotor have a solid structure, mounted on a star carrier.

Referring now to the figures of the drawings in detail and first, particularly, to FIG. 1 thereof, there is seen a star carrier 1 which has three arms. One arm 2 that is directed upward lies in the drawing plane of FIGS. 1, 3 and 5. Two arms that are directed downward point respectively downward and forward out of the drawing plane and are therefore not illustrated. According to FIG. 1, the star carrier 1 is fastened to a rear bottom wall 3 of a tub through the use of screws which are not illustrated. In order to mount a shaft journal 4 of a non-illustrated laundry drum, the star carrier 1 has a bearing sleeve 5 with rolling bearings. Moreover, starting from the star carrier 1, a fastening flange 6, to which a motor 7 can be screwed, extends in the same direction in FIGS. 1 and 3.

Figure 2:
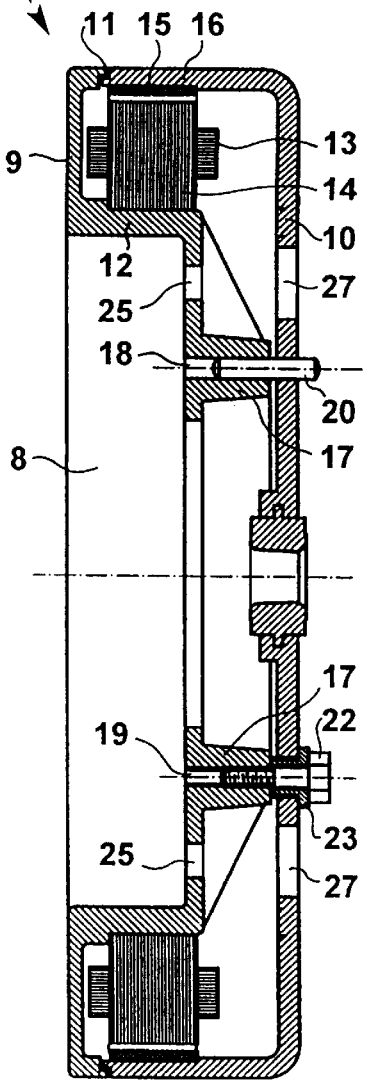
FIG. 2 is a sectional view of the version according to FIG. 1 prior to mounting on the star carrier.

The motor 7 illustrated in FIGS. 1 and 2 has a dish-shaped stator carrying part 8 with an outer edge 9 which extends as far as an edge of a rotor or rotor bell 10. The outer edge 9 and the edge of the rotor 10 together form a labyrinth seal 11. Exciting windings 13, together with laminations 14 thereof, are distributed circumferentially on a projecting portion 12 of the stator carrying part 8. An airgap separates the exciting windings from oppositely disposed magnetizable poles 15 which are fastened to an inner periphery of a bell edge 16 of the rotor 10.

The stator carrying part 8 has a surface pointing toward the rotor 10 with a ring of locking lugs 17 which reach to just in front of an inner surface of the rotor bell 10. The locking lugs 17 have smooth-walled locking holes 18 or threaded locking holes 19. Locking pins 20, which match corresponding locking holes 21 in the rotor bell 10, are inserted into the smooth-walled locking holes 18 for transport. At least one and preferably two or more of the locking lugs 17 have the threaded holes 19 for screwing in locking screws 22, through the use of which a transport position can be immovably fixed. In order to provide exact depth positioning, while preserving the necessary distance of the rotor bell 10 from the stator carrying part 8, a spacer sleeve 23 must be inserted before the locking screws 22 are screwed in.

When the motor 7 is being assembled at the home factory, at a point in time after the stator carrying part 8 has been completed with the bundle of laminations 14 and the windings 13 and after the rotor 10 has been completed with the magnetizable poles 15, the rotor bell is laid flat onto the stator carrying part and the locking position is located. If appropriate, this position is then already secured through the use of the locking pins 20 in the smooth-walled holes 18. The spacer sleeves 23 are then inserted into those holes of the rotor bell under which the matching threaded holes 19 are located. Finally, the locking screws 22 are led into the spacer sleeves 23 and screwed in the threaded holes 19. The motor is thus ready for testing and delivery.

At the factory manufacturing washing machines, the rotor bell of this motor 7 is placed onto a threaded stub 24 of the shaft journal 4, screwed on and secured through the use of a screw in a non-illustrated manner, in a position in which the stator carrying part 8 bears on the fastening lugs 6 of the star carrier 1. Fastening holes 25 in the stator carrying part 8 are then brought into coincidence with the fastening lugs 6, and fastening screws 26 are screwed in. Machining orifices 27 in the rotor bell 10 serve to provide access to the fastening screws 26. The locking pins 20 and the locking screws 22 are subsequently unscrewed and the spacer sleeves 23 are extracted. The locking pins 20 and the locking screws 22 as well as the spacer sleeves 23 may be sent back to the motor factory as returned parts.

Figure 3:
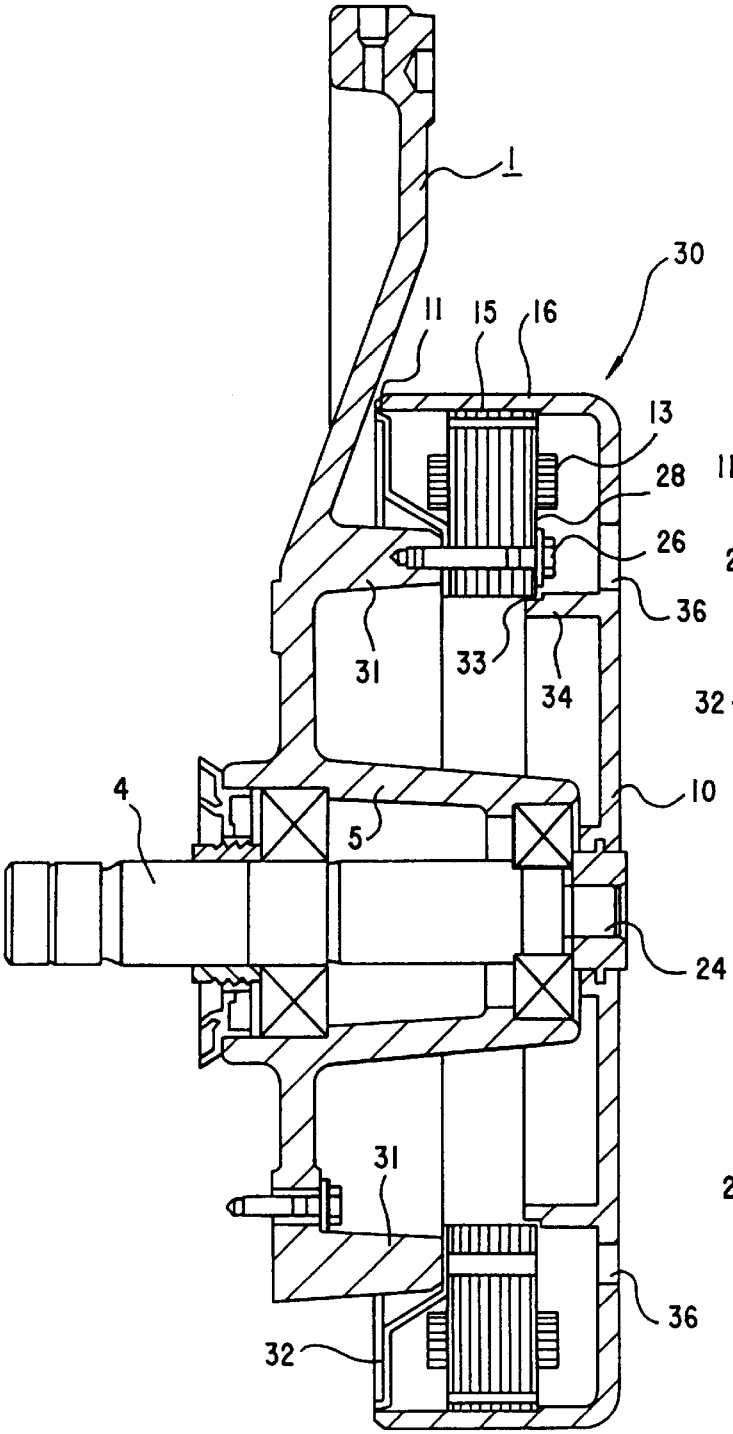
FIG. 3 is a view similar to FIG. 1 of another version, in which a ring of exciting winding laminations at the same time forms the stator carrying part, already mounted on the star carrier.
Figure 4:
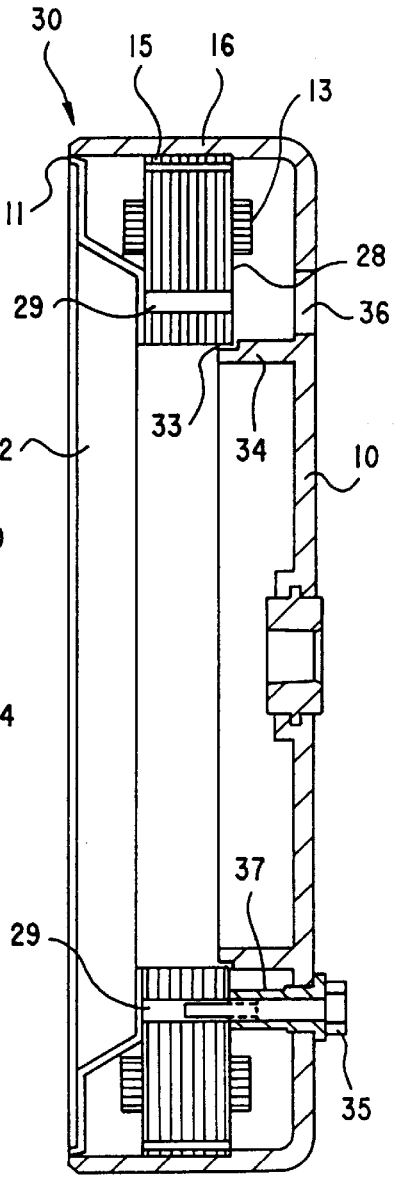
FIG. 4 is a sectional view of the version according to FIG. 3 prior to mounting on the star carrier.

The basic structure of a motor 30 according to FIGS. 3 and 4 and of its connection to the star carrier is similar to that of FIGS. 1 and 2. The stator carrying part 8 according to FIGS. 1 and 2 is dispensed with or is formed by a bundle of laminations 28 which is composed of individual annular laminations. The bundle of laminations also extends further toward the center of rotation than the bundle of laminations 14 of the motor 7 in FIGS. 1 and 2. This is because the bundle of laminations is provided with fastening holes 29 on a circle located near the center of rotation, through the use of which the motor 30 can be mounted on fastening lugs 31 of the star carrier 1 through the use of fastening screws 26.

Moreover, a dish-shaped ring 32, which may likewise be formed of sheet metal or plastic, is also mounted on the bundle of laminations 28 between the latter and the star carrier 1. The ring serves as a protection against the penetration of dust which may considerably impair the proper operation of the motor 30, above all when in the form of magnetizable dust. For this purpose, the ring 32 forms the labyrinth-like seal 11 together with the edge 16 of the rotor bell 10. Such a labyrinth seal 33 is formed, on the inside of the annular space for the exciting windings 13 and the poles 15, by an inner edge of the bundle of laminations 28, together with a peripheral collar 34 on the inside of the rotor bell 10.

The fastening holes 29 serve not only for fastening the motor 30 to the star carrier 1, but also for fixing the motor parts (stator and rotor) relative to one another before the motor 30 is installed. For this purpose, the fastening holes 29 or some of them are provided with an internal thread. In this case, the core diameter of the latter is at least as large as the nominal diameter of the fastening screws 26. However, the nominal diameter of the internal thread corresponds exactly to that of locking screws 35, through the use of which the motor parts are fixed. Furthermore, spacer sleeves 37 are inserted for this purpose into the machining orifices 36 provided for access to the fastening screws 26. The spacer sleeves 37 maintain a definite distance between the rotor bell 10 and the bundle of laminations 28 when the locking screws 35 are screwed into the thread of the fastening holes 29. Instead of these dimensional dependencies between the diameters of the fastening holes and the respective screws, some of the holes on this circle may serve solely as fastening holes 29 and others as locking holes. In order to distinguish them more easily, these two types of holes may also lie on circles having different radii. The holes in the rotor bell 10 may then also have different diameters. For example, the machining holes 36 may have a larger diameter than the holes provided for the spacer sleeves 37.

The motor 30 is installed at the factory manufacturing washing machines in a simple manner, similar to the example of FIGS. 1 and 2. The rotor bell 10 is first screwed onto the threaded stub 24, until the outer surface of the ring 32 comes to bear on the fastening lugs 31. This position is then secured in relation to the shaft journal 4, by a screw or the like. If the fastening holes are different from the locking holes, the fastening screws 26 are first screwed through the machining holes 36 into the fastening lugs 31. The locking screws 35 and the spacer sleeves 37 are then removed and returned to the motor manufacturer. If the fastening holes and locking holes are identical, only some, for example three, of the holes are used for locking through the use of the spacer sleeves 37 and the locking screws 35. The same procedure as mentioned above may then be adopted. However, if all of these holes, for example more than three, have been used for locking, then assembly must be carried out in steps. In other words, first one locking screw 35 and the associated spacer sleeve 37 are removed and a fastening screw 26 is introduced and screwed tight there. The same procedure is then carried out in steps for the remaining holes.

Figure 5:
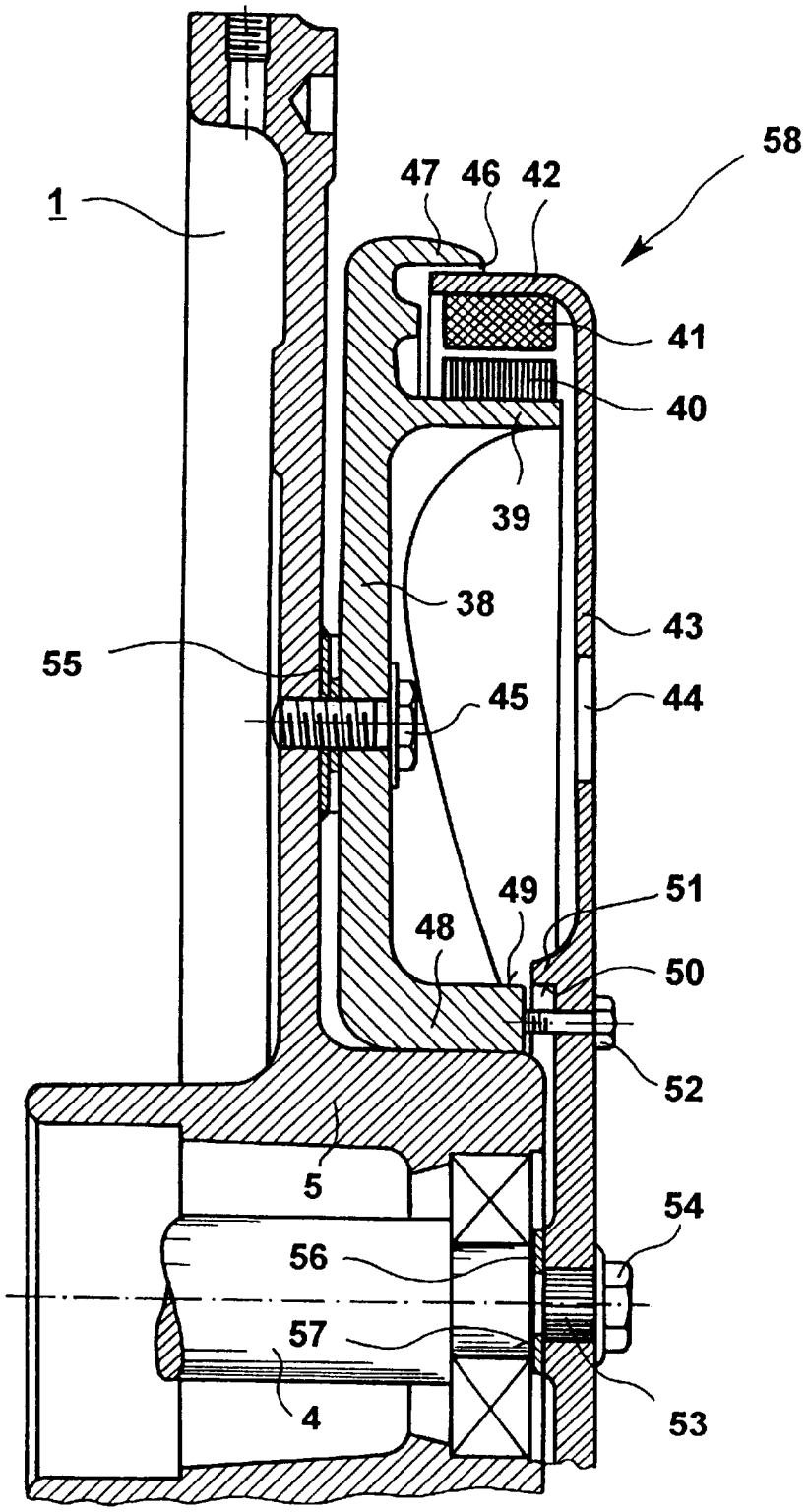
FIG. 5 is an enlarged, fragmentary, sectional view of a third version with a guide sleeve on the stator carrying part, in which a collar of the rotor already secures the transport position on the guide sleeve.

FIG. 5 illustrates an example of a motor 58 including a stator carrying part 38 having a peripheral collar 39 that is likewise equipped with exciting windings 40 and bundles of laminations that are located opposite magnetizable poles 41, across an airgap. These poles are fastened in the same way as in the examples described above, to an inner periphery of an edge 42 of a rotor bell 43 which is provided with machining holes 44 for fastening screws 45. A region formed by an overlapping flange 47 of the stator carrying part 38 serves as a labyrinth seal 46. There is no need for a special seal on the inside, because in any case this region is dust-tight by virtue of the structure described.

The stator carrying part 38 has a central guide sleeve 48 with an outer cylindrical surface 49 which forms a sliding fit (for example, H7/j6) together with a short inner cylindrical surface 50 of an annular bead 51 on the rotor bell 43. The sliding fit serves for securing the motor parts in position during transport. In this secured position, the motor parts are fixed through the use of transport securing screws 52 and sit with their end surfaces against one another. In this case, the bundle of laminations of the exciting windings 40 is offset inward, for example by 6 to 7 mm, in relation to the poles 41.

The guide sleeve 48 likewise has an inner cylindrical surface which forms a sliding fit (for example, likewise H7/j6) in relation to an outer cylindrical surface of a bearing sleeve 5. The guide sleeve 48 is pushed onto the bearing sleeve 5 and the rotor bell 43 is led with its central hole into a serration of a shaft stub 53, for assembly. A central shaft screw 54 is tightened slightly, and the transport securing screws 52 are unscrewed. After the fastening screws 45 have been tightened firmly, the shaft screw may also be tightened. A spacer disk 55 between the stator carrying part 38 and the star carrier 1 on one hand, and a spacer disk 56 between the rotor bell 43 and a shoulder 57 on the shaft journal 4 on the other hand, ensure that the motor parts are correctly coordinated dimensionally in relation to one another in the installed state.

All of the presented examples of the drive device according to the invention have another essential advantage in common: they make do with fewer or smaller rolling bearings for the shaft journal 4, as compared with previous known proposals.

We claim:

1. In a washing machine including a tub having a rear side with a bottom wall, a rigid star carrier attached to the bottom wall of the tub and having a bearing sleeve, an at least approximately horizontally disposed shaft mounted in the bearing sleeve, and a laundry drum mounted on the shaft, a drive device to be mounted at the rear side of the tub for directly driving the shaft, comprising:

a flat motor having a stator carrying part with exciting windings and a rotor with magnetizable poles, said stator carrying part and said rotor releasably connected to one another with said stator carrying part in a position relative to said rotor corresponding to an operating position, for a duration of transport of said motor until a final mounting on the bottom wall of the tub.

2. The drive device according to claim 1, wherein said stator carrying part and said rotor have identical hole patterns with bores, at least one of said bores of said hole pattern in said stator carrying part has a thread, and a locking screw is screwed in said thread from said rotor.

3. The drive device according to claim 2, wherein at least one of said bores of said hole pattern in said stator carrying part has a smooth wall and the same diameter as at least one of said bores of said hole pattern in said rotor, and a locking pin is introduced in said bores for securing said stator carrying part and said rotor in position during transport.

4. The drive device according to claim 2, wherein said bearing sleeve of said star carrier has an outer cylinder, and said stator carrying part has a central guide sleeve to be placed onto said outer cylinder with a defined sliding fit.

5. The drive device according to claim 4, wherein said rotor has a side facing an interspace, a bead is attached on said side of said rotor, and said bead has an inner surface, and said guide sleeve has an outer surface forming a cylindrical fit with said inner surface of said bead, said bead seated on said outer cylindrical fit in a transport position.

6. The drive device according to claim 5, including locking screws penetrating into threaded bores in an end surface of said guide sleeve, in the transport position.

7. The drive device according to claim 1, wherein said rotor has a bell shape and a central part with a flat disk shape and access bores on a circle with a given radius, said stator carrying part has fastening bores on a circle with said given radius, and said star carrier has threaded holes on a circle with said given radius for mounting said motor on said star carrier.

8. The drive device according to claim 1, wherein said stator carrying part is formed of a ring of laminations for said exciting windings.

9. The drive device according to claim 8, wherein said rotor has a bell edge, said ring of laminations has a side facing said star carrier with a dish-shaped ring having an outer edge reaching to said bell edge, and said bell edge and said outer edge of said ring form a labyrinth seal.

10. The drive device according to claim 1, wherein said rotor has a bell with an edge, and said stator carrying part extends beyond said exciting windings and has an edge forming a labyrinth seal together with said edge of said bell.

11. The drive device according to claim 10, wherein at least one of said stator carrying part and said bell has a peripheral collar facing an interspace and at least another of said stator carrying part and said bell has a counterpart, said peripheral collar and said counterpart together forming a labyrinth seal.

* * * * *